United States Patent [19]

Cazaly et al.

[11] Patent Number: 4,578,921

[45] Date of Patent: Apr. 1, 1986

[54] STORAGE TANK CONSTRUCTION

[76] Inventors: Laurence G. Cazaly, 19 Bryson Drive, Thornhill, Ontario, Canada, L4C 6E2; Douglas Lamon, 1089 North Service Road, Winona, Ontario, Canada, L0R 2L0

[21] Appl. No.: 698,519

[22] Filed: Feb. 5, 1985

[51] Int. Cl.[4] ..... E04B 1/00

[52] U.S. Cl. ..... 52/741; 52/745

[58] Field of Search ..... 52/741, 742, 73, 197

[56] References Cited

U.S. PATENT DOCUMENTS

| | | | |
|---|---|---|---|
| 2,812,574 | 11/1957 | Wiggins | 52/745 X |
| 2,899,820 | 7/1959 | Headrick . | |
| 3,073,018 | 1/1963 | Gauthron | 52/745 X |
| 3,268,999 | 8/1966 | Wiggins | 52/745 |
| 3,672,115 | 6/1972 | Abe et al. | 52/741 |
| 4,312,167 | 1/1982 | Cazaly et al. | 52/745 |
| 4,327,531 | 5/1982 | Cazaly et al. | 52/73 |
| 4,403,460 | 9/1983 | Hills . | |
| 4,486,989 | 12/1984 | DesRochers et al. | 52/745 X |
| 4,513,550 | 4/1985 | Kotcharian | 52/741 X |

OTHER PUBLICATIONS

"Water Tank is Jacked into Place", Engineering News Record, Feb. 14, 1963, p. 69.

*Primary Examiner*—Donald G. Kelly
*Assistant Examiner*—Creighton Smith
*Attorney, Agent, or Firm*—Panitch, Schwarze, Jacobs & Nadel

[57] ABSTRACT

This invention relates to an elevated liquid storage tank and a method of constructing same. An upright, hollow, cylindrical concrete shaft is constructed having a closed upper end portion forming a tank support floor. An upper, outer ledge is formed around the periphery of the shaft adjacent to the tank support floor; and a central, upright access tube is mounted in the tank support floor. An annular, steel tank wall is fabricated around the base of the shaft and hoisted to the top of the shaft using a plurality of jacks. The tank wall includes a lower annular ring beam and the space between the ring beam and the shaft upper end portion is filled with reinforced concrete to connect and retain the tank in position. Roof plates extend between the access tube and the tank wall to close the storage tank roof.

11 Claims, 15 Drawing Figures

STORAGE TANK CONSTRUCTION

BACKGROUND OF THE INVENTION

This invention relates to elevated liquid storage tanks and methods of constructing same.

In the past, it has been common practice to construct elevated liquid storage tanks, which are sometimes referred to as water towers, either out of concrete or structural steel. An economical form of concrete storage tank is a simple concrete cylinder which may be completely hollow, or it may be formed with an elevated concrete floor, the tank of course being that part of the cylinder above the floor. A difficulty with this type of storage tank is that it lacks aesthetic appeal. Also, in cold climates it is usually not desirable to have the concrete in contact with the liquid being stored, because freezing and thawing can have a deleterious effect on the concrete. Of course, a liner or some form of coating could be used to protect the concrete, but this increases the cost of the storage tank considerably and can cause maintenance problems, especially if leaks appear in the liner or coating.

An all steel elevated storage tank is sometimes better than a concrete storage tank from the point of view of water tightness and associated maintenance problems. Most elevated steel storage tanks, however, are supported on structural steel tower structures which are themselves aesthetically unappealing, not to mention the maintenance problem of having to periodically paint the structural steel tower.

As an improvement over the all steel or all concrete constructions elevated storage tanks have been made where the tower or column part is formed of concrete and the tank itself is formed of steel. Ordinarly, it would be very costly to fabricate a steel tank on the top of a concrete tower, but a method has been used in the past to construct a major portion of the steel tank at ground level and hoist same into position at the top of the concrete tower where a concrete tank floor is poured to interlock the steel tank and the concrete tower. This prior art method of construction is described in the applicants' previous Canadian Pat. No. 1,091,883 and U.S. Pat. No. 4,312,167. The construction of the storage tank itself is described in applicants' previous Canadian Pat. No. 1,091,884 and U.S. Pat. No. 4,327,531. While the liquid storage tanks described in these patents are aesthetically appealing, economical to produce and relatively maintenance free, the elevated storage tank and method of construction of the present invention is an improvement thereover, in that the storage tanks of the present invention are even more economical to produce, and if desired, the tank portion can be made into a continous steel water containment chamber, so that none of the structural concrete comes into contact with the liquid in the tank.

SUMMARY OF THE INVENTION

According to one aspect of the invention, there is provided an elevated liquid storage tank comprising an upright, hollow, cylindrical shaft adapted to be anchored to a supporting base foundation. The shaft has an upright wall and a closed upper end portion with a top surface forming a partial tank support floor. The upper end portion has an upper, outer ledge formed around the periphery of the shaft spaced below the top surface. A tank is mounted at the top of the shaft, the tank including a wall having a lower annular ring beam attached thereto and forming a lower tank opening. The ring beam has radially, inwardly projecting support means, the ring beam and tower upper end portion forming an annular recess. Also, means are provided for filling the recess to connect the tank to the shaft and complete the tank support floor.

According to another aspect of the invention, there is provided an elevated storage tank comprising an upright, hollow cylindrical shaft adapted to be anchored to a supporting base foundation. The shaft has an upright wall and a closed upper end portion with a top surface forming a tank support floor. A tank is mounted at the top of the shaft, the tank having a peripheral wall connected to the shaft around the top peripheral edge of the shaft adjacent to the tank support floor. A central, upright access tube assembly is mounted in the tank support floor, and a plurality of radial roof closing members are supported by and extend radially, outwardly from the top of the access tube assembly to the tank wall to form the tank roof.

According to yet another aspect of the invention, there is provided a method of constructing an elevated liquid storage tank comprising the steps of erecting an upright, hollow, cylindrical shaft including a closed upper end portion forming a partial tank support floor having a top surface. The shaft also includes an upright wall having an upper, outer ledge formed around the periphery of the shaft and spaced below the top surface. A partial annular steel tank is fabricated concentrically about the base of the shaft. The partial tank includes a wall having a lower annular ring beam with inwardly projecting support members. The partial tank is hoisted to the top of the shaft so that the ring beam is opposite to the ledge forming a continuous annular recess around the periphery of the shaft, and the annular recess is filled with reinforced concrete to connect the partial tank to the shaft.

DETAILED DESCRIPTION OF PREFERRED EMBODIMENTS

Figures 1, 2, 3:
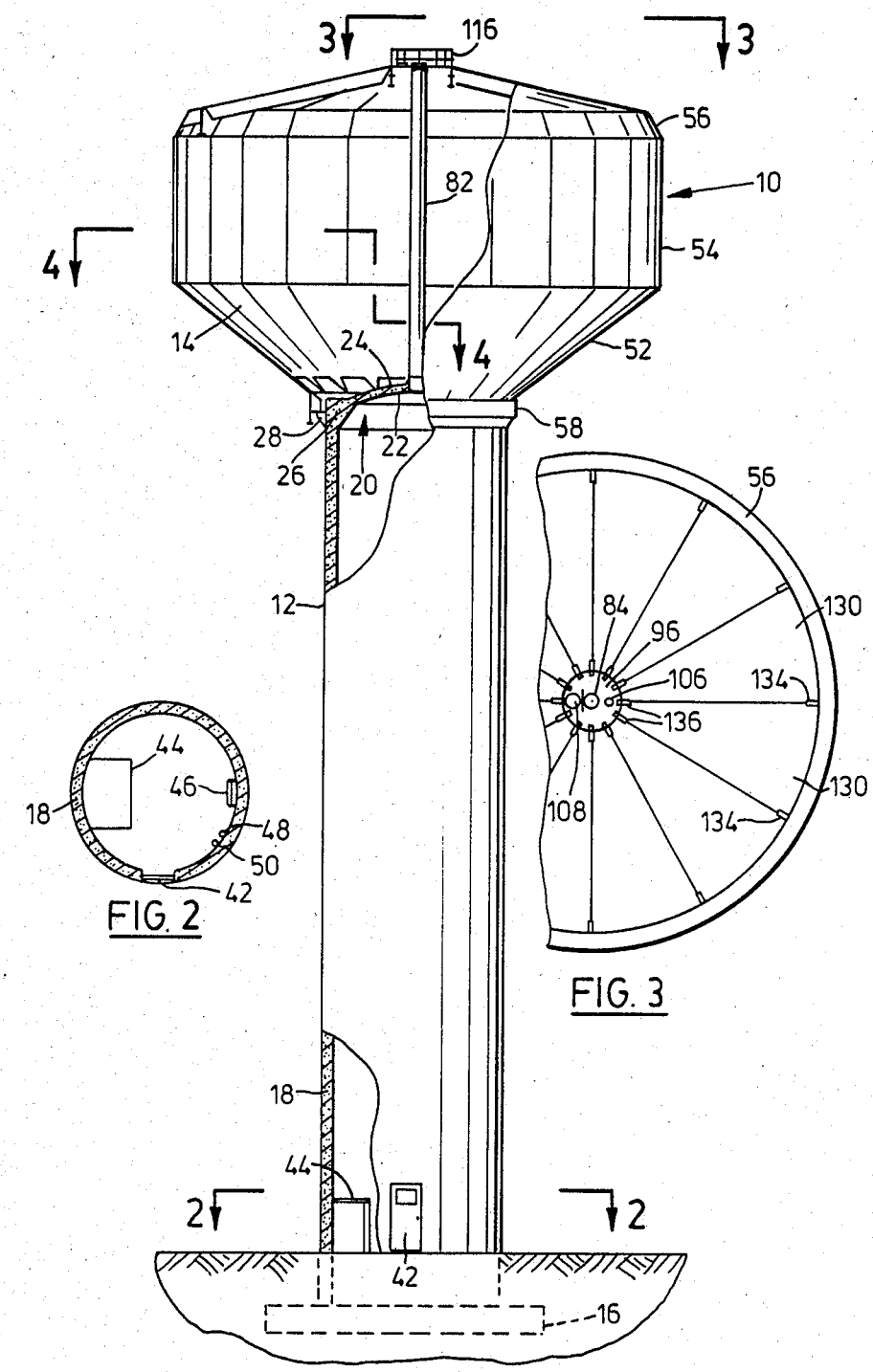
FIG. 1 is a diagrammatic, vertical elevational view, partly broken away, of a preferred embodiment of an elevated liquid storage tank according to the present invention.
FIG. 2 is a sectional view taken along lines 2—2 of FIG. 1.
FIG. 3 is a partial plan view taken along lines 3—3 of FIG. 1.

Referring to the drawings, a preferred embodiment of an elevated liquid storage tank or tower according to the present invention is generally indicated by reference numeral 10. Storage tank 10 includes an upright, hollow, cylindrical shaft 12 formed of reinforced concrete and a steel tank 14 mounted on top of the shaft. Shaft 12 is supported on a foundation 16 indicated by dotted lines in FIG. 1. Foundation 16 is not considered to be part of the present invention, so it will not be described in detail. However, it will be appreciated by those skilled in the art that foundation 16 must be suited to the soil conditions and capable of supporting the weight of the storage tank 10 and the liquid contained therein.

Shaft 12 is shown to be circular in cross-section in the drawings, but it could be octagonal or hexagonal or have any other cross-sectional configuration as desired. The term "cylindrical" as used in this specification is intended to include any desired cross-sectional configuration. For the purposes of clarity, the reinforcing steel used in concrete shaft 12 and perhaps foundation 16 has been omitted. The exact pattern and type of reinforcement used in shaft 12 is conventional and typically would include steel reinforcing bar and welded wire mesh as required.

The dimensions of storage tank 10 are such that tank 14 would typically hold between 100,000 and 3,000,000 gallons (450,000 to 13,000,000 liters) of liquid, such as water, at a height of about 100 to 150 feet (30 to 45 meters) above the ground. Shaft 12 is typically 10 to 50 feet (3 to 15 meters) in diameter, with a wall thickness of between 6 and 20 inches (15 to 50 centimeters).

Figure 13:
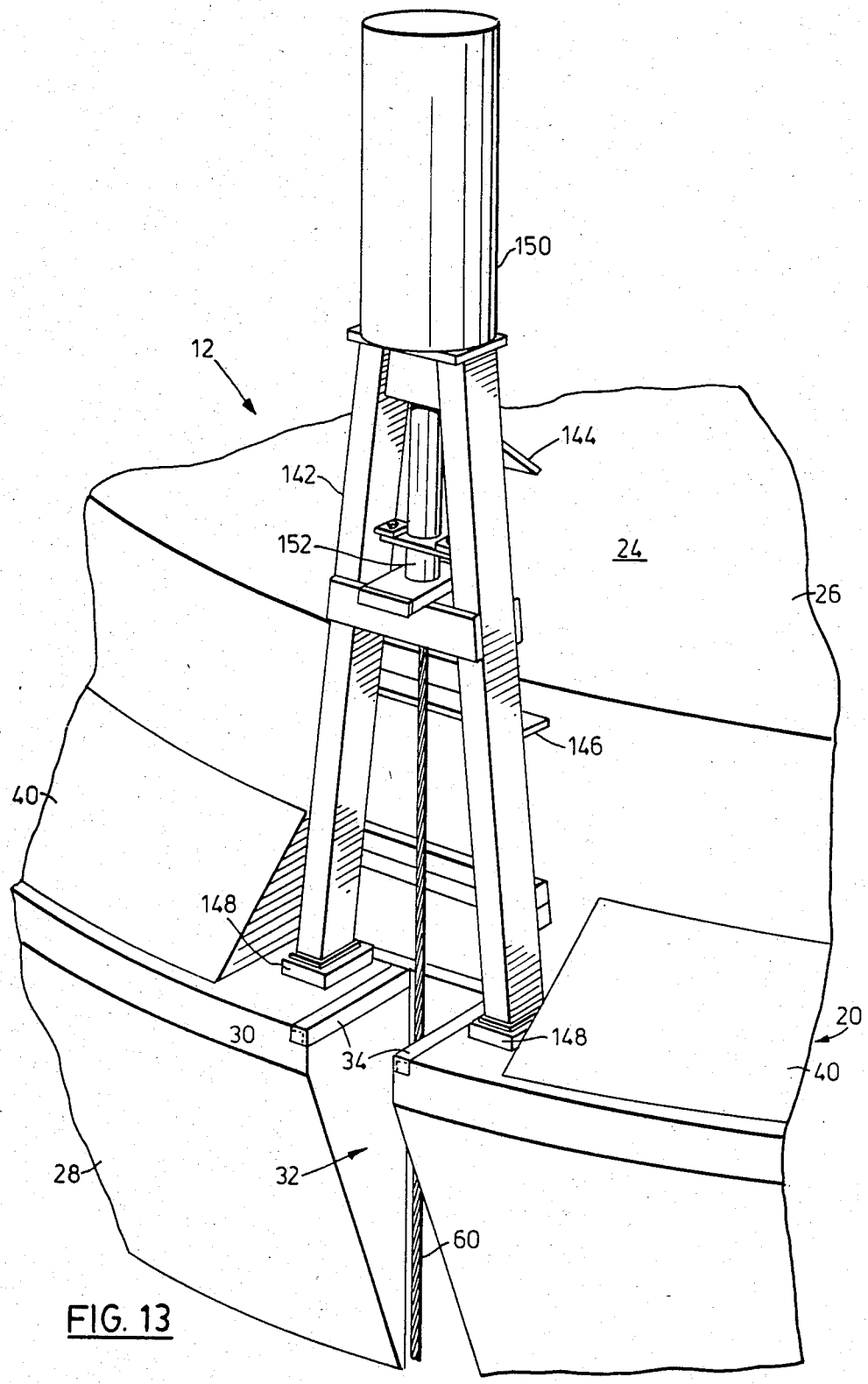
FIG. 13 is a perspective view of a portion of the shaft upper end portion showing a jack mounted on the peripheral ledge with a lifting cable passing therethrough to raise the tank.

As seen best in FIGS. 1, 2, 5 and 8, shaft 12 includes an upright wall 18 and an upper end portion 20 including a partial tank support floor 22 having a top surface 24. Partial tank support floor 22 and upright wall 18 are joined together by an integral, enlarged peripheral thrust ring 26. The mass of thrust ring 26 is balanced about the centre line of the partial tank support floor 22 to minimize bending stresses in the support floor 22 and the shaft wall 18. Partial tank support floor 22 supports only an interior part of the complete tank, as will be described further below. In the preferred embodiment, a corbel 28 is formed adjacent to the shaft upper end portion 20 and the upper surface of corbel 28 forms an upper, outwardly disposed outer ledge 30 (see FIG. 13) on which steel tank 14 is mounted. Outer ledge 30 is spaced below top surface 24 and extends around the periphery of shaft 12. Outer ledge 30 and corbel 28 are formed with a plurality of radially disposed outwardly opening recesses 32, the purpose of which will be described further below. The top edges of recesses 30 are reinforced by steel angles 34 which are cast into the concrete when it is poured. As seen best in FIG. 6, steel angles 34 have forward anchors 36 and a rear bridge member 38 to increase the reinforcing capability of the angles. Concrete gussets 40 are formed between outer ledge 30 and thrust ring 26, so that the resulting construction joint at the surface of gussets 40 is perpendicular and symmetrically placed about the line of thrust indicated by chain dotted line 41 (see FIG. 5). Thrust line 41 is the line of thrust of the floor of steel tank 14 when it is filled with liquid. Concrete gussets 40 extend circumferentially around the upper end portion 20 with interruptions at each recess 32 as seen best in FIG. 13.

Shaft 12 is also formed with the usual access door 42 and a machine room 44 for housing the usual pumps, valves and controls, etc. A ladder 46 is mounted on the inside of shaft wall 18 for gaining access to tank 14 and the usual fill and drain pipes 48, 50 are also mounted on the inside of wall 18 leading up to tank 14.

The wall of steel tank 14 has several parts or portions starting at the bottom with an upwardly and outwardly disposed conical floor portion 52, a vertical side wall portion 54 attached to floor portion 52, and an upwardly and inwardly disposed conical top wall portion 56 attached to side wall portion 54. For the purposes of this specification, floor portion 52, side wall portion 54 and top wall portion 56 are all considered to be part of the wall of steel tank 14, although floor portion 52 could be considered to form part of the floor of the completed tank.

Floor portion 52 is attached to an annular ring beam 58 which is itself formed of several components. Ring beam 58 serves two main functions. During the lifting of the tank into position at the top of shaft 12, ring beam 58 provides a stiff member to distribute the local point reactions applied by the attachment of lifting cables 60 (see FIGS. 12 and 13). When tank 14 is in its final position, ring beam 58 serves as a means for transferring the structural forces from the tank floor portion 52 into the concrete of the upper end portion 20 of shaft 12.

Figure 5:
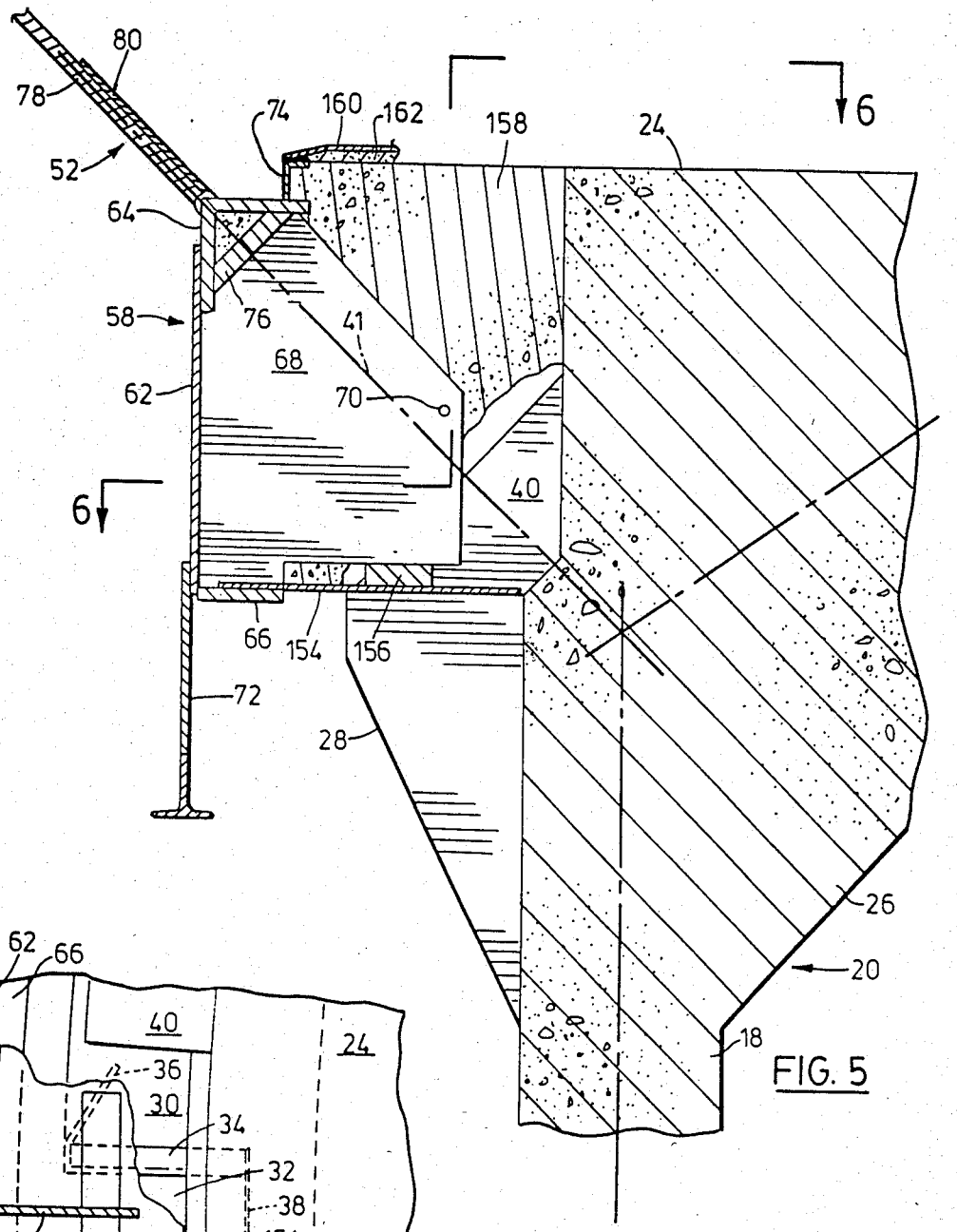
FIG. 5 is a vertical sectional view taken along lines 5—5 of FIG. 4.
Figure 6:
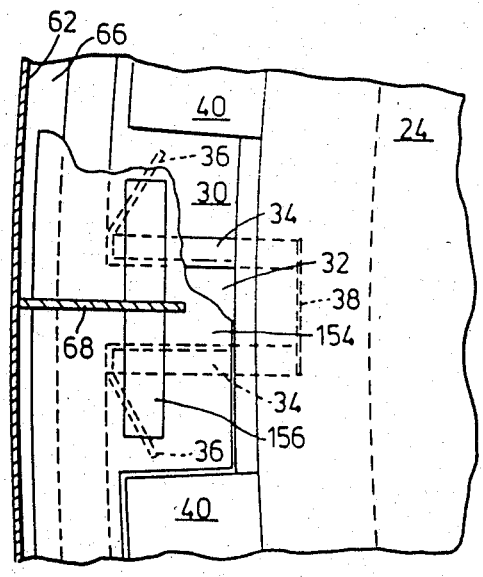
FIG. 6 is a partial plan view taken along lines 6—6 of FIG. 5 with the concrete removed from the annular recess between the tank ring beam and the shaft end portion thrust ring.

As seen best in FIG. 5, ring beam 58 includes an annular vertical skirt 62 and a top angle 64 to which floor portion 52 is attached. Ring beam 58 also includes an annular bottom plate 66 and vertical knife plates 68. Knife plates 68 have lifting holes 70 for attachment of lifting cables 60. Knife plates 68 are typically circumferentially spaced apart at about 5 foot (1.5 meter) intervals. Ring beam 58 also includes a lower painter's rail 72 and an upper forming angle 74. Top angle 64 also has circumferentially spaced apart strengthening gussets 76. Top angle 64 and knife plates 68 are radially inwardly projecting support means for tank 14. The various components of ring beam 58 are dimensioned so that the ring beam provides the necessary bending and torsional support for lifting and retaining tank 14 in position as mentioned above.

Figure 4:
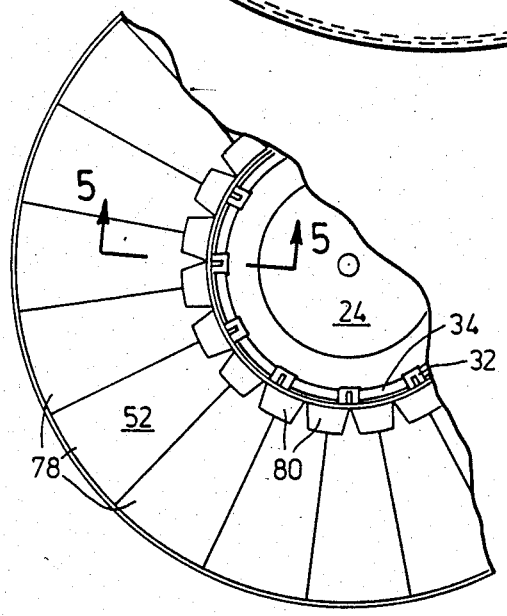
FIG. 4 is a partial plan view taken along lines 4—4 of FIG. 1.

As seen best in FIG. 4, the tank floor portion 52 is formed of a plurality of steel plates in the form of conical segments 78. If desired, conical segments 78 can be formed with inner and outer portions, the inner portions being thicker for higher strength. Radial strengthening plates 80 are provided at the junctions of the segments 78 with the ring beam top angle 64. It will be appreciated that ring beam 58 forms a lower tank opening before the tank is hoisted and secured in position. The knife plates 68 project radially, inwardly to rest on outer ledge 30 to support the tank while it is being secured in position, as will be discussed further below.

The chain dotted lines in FIG. 5 indicate the direction of the thrust from the tank wall and the tank support floor. The angle of inclination of the floor portion 52 and the convexity of the partial tank support floor 22 are such that the thrust from the floor portion and the thrust from the tank support floor meet approximately at the centre line of shaft wall 18 when tank 14 is filled with liquid.

Figure 7:
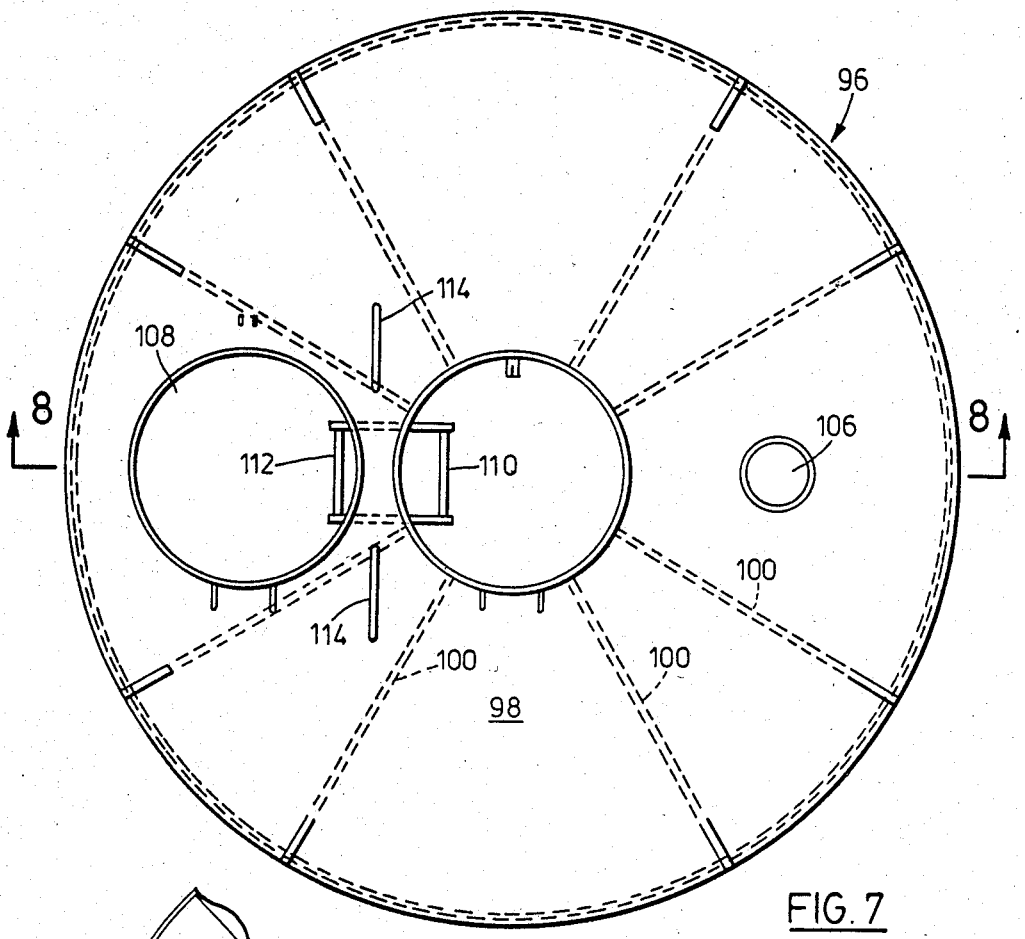
FIG. 7 is a plan view of the roof landing showing the access openings for access to the inside of the tank.
Figure 8:
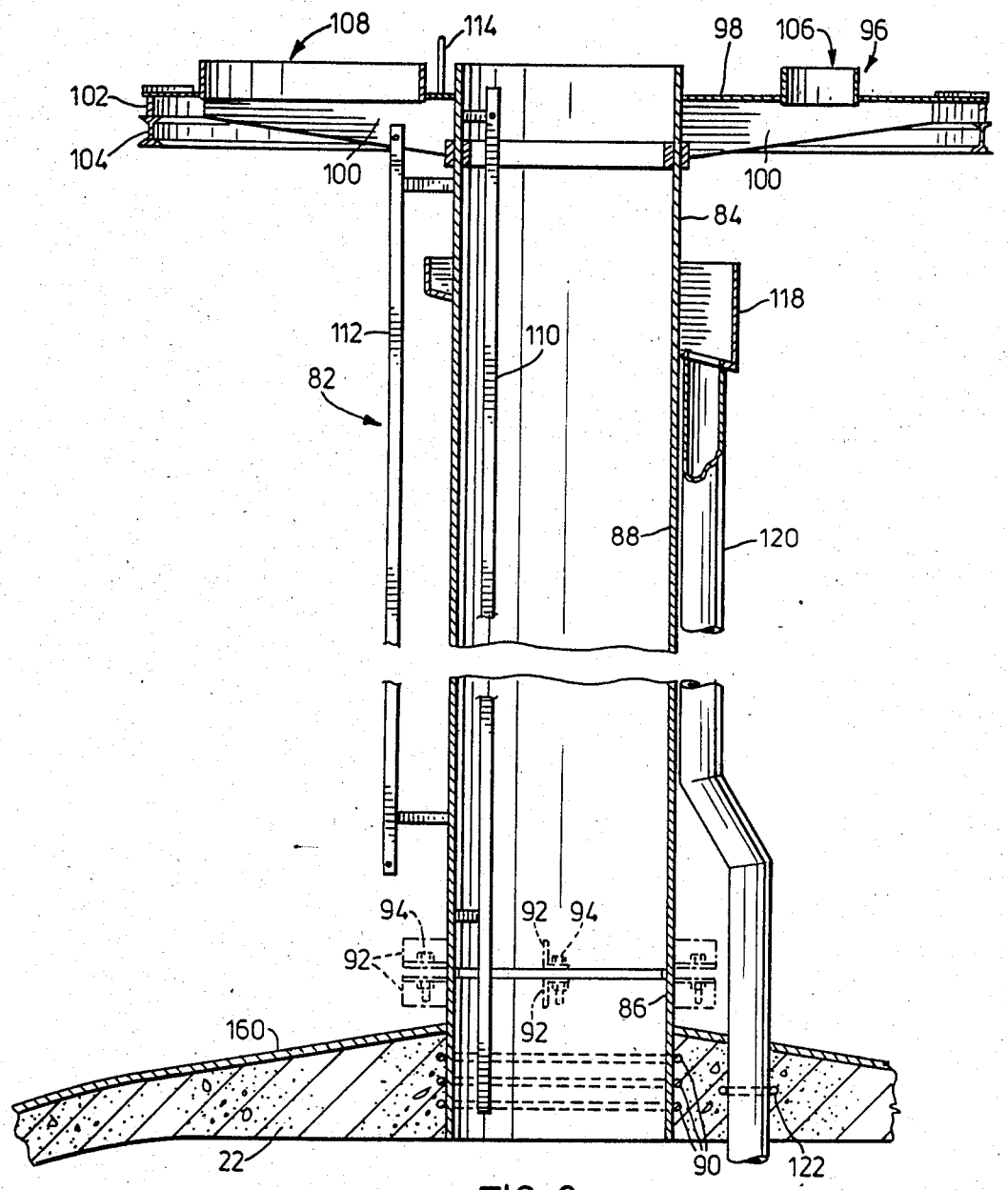
FIG. 8 is a vertical sectional view of the central access tube and roof landing taken along lines 8—8 of FIG. 7.

Referring next to FIGS. 1, 7 and 8, a central vertical access tube assembly 82 is mounted in partial tank support floor 22 for access from the inside of shaft 12 to the roof of the structure. Access tube assembly 82 includes a central tube 84 having a lower portion 86 cast into the concrete of partial tank support floor 22, and an upper portion 88 joined to lower portion 86. Annular flanges 90 are attached to lower portion 86, and partial tank support floor 22 is thickened to form a haunch about lower portion 86 which locks to flanges 90 to fully support the access tube assembly. By forming central tube 84 in two parts, the lower portion 86 can be easily cast into the partial tank support floor, and thereafter, the upper portion 88 is just attached thereto. For this purpose, temporary angle brackets 92 and leveling bolts 94 can be provided at the connection of the two portions 86, 88. After plumbing and aligning the upper portion 86, the two tube portions are welded together and temporary angle brackets 92 and leveling bolts 94 are removed.

A roof landing 96 is mounted at the top of central tube 84. Roof landing 96 includes a top plate 98 and a plurality of radial support members 100. The periphery of roof landing 96 has an annular stiffening member 102 and a painter's rail 104 is attached thereto. A vent opening 106 and an access opening 108 are provided in top plate 98 and suitable covers are provided for vent opening 106, access opening 108, and the top of central tube 84. Ladders 110, 112 are attached to central tube 84, so that a person can climb upwardly inside tube 84 out on to roof landing 96 and down through access opening 108 into the interior of tank 14. Grip rails 114 are provided as well as an upper railing 116 (see FIG. 1) for safety purposes. An overflow weir 118 is mounted near the top of tube 84 and a drain pipe 120 passes downwardly from weir 118 through partial tank support floor 22 to be connected to the drain pipe 50 mounted on the inside of concrete shaft 12. A flange 122 is attached to drain pipe 120 where it passes through partial tank support floor 22 and performs a function similar to flanges 90.

Figure 10:
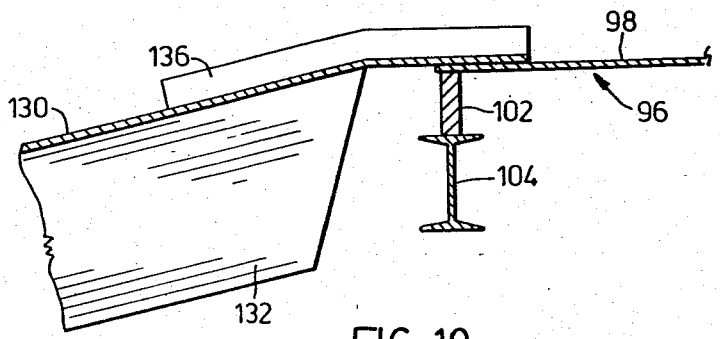
FIG. 10 is a vertical sectional view of the intersection of one of the roof plates and the roof landing.
Figure 11:
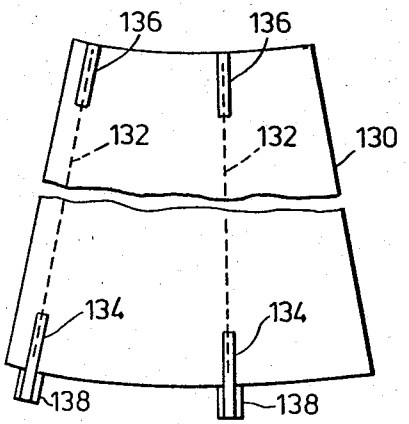
FIG. 11 is a plan view of one of the roof plates.
Figure 9:
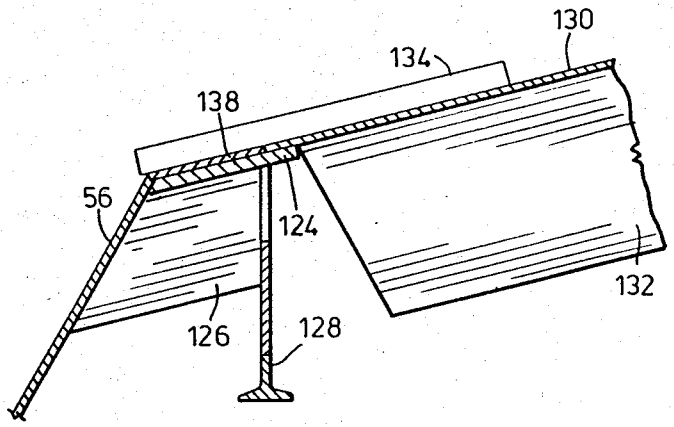
FIG. 9 is a vertical sectional view of the intersection of the tank top wall portion and one of the roof plates.

Referring next to FIGS. 9, 10 and 11, the tank roof will now be described in detail. It will be noted from FIG. 9 that the upper peripheral edge of top wall portion 56 is formed with a stiffening rim element 124 held in position by gussets 126. An interior painter's rail 128 is attached to gussets 126. Roof plates 130 span the distance between the top wall portion 56 and roof landing 96. As seen best in FIG. 11, roof plates 130 are in the form of conical segments. Radial stiffening ribs 132 are provided on the underside of roof plates 130 and knives 134, 136 are provided on top of roof plates 130 above stiffening ribs 132 to support the roof plates in position. It will be appreciated that knives 134 extend beyond roof plates 130 to overlap rim elements 124, so spacer plates 138 are used to fill the gap therebetween. Spacer plates are not required at the inner ends of roof plates 130, because the roof plates themselves extend inwardly to overlap the roof landing top plate 98. It will be seen from FIG. 11, that the knives 134, 136 and associated stiffening ribs 132 are located closer to one side edge of roof plate 130 than the other. This is to keep one side edge of the roof plate straight. The other side edge, therefore, is a little more flexible so that it can conform with the adjacent mating side edge of the next plate. However, if desired, stiffening ribs 132 can be evenly spaced from each longtitudinal edge of roof plate 130 or other combinations of roof elements can be employed.

The method of constructing storage tank 10 begins with the erection of upright, hollow, cylindrical shaft 12 including the closed upper end portion 20. Shaft 12 can be constructed using any suitable procedure such as a jump forming or slip forming techinque. A particularly convenient method and apparatus is described in applicants' previous Canadian Pat. No. 1,091,883 and the corresponding U.S. Pat. No. 4,312,167. Of course, prior to erecting shaft 12, a suitable foundation 16 would be constructed, and while partial tank support floor 22 is being made, central tube lower portion 86, drain pipe 122 and a similar fill pipe would also be installed. Otherwise, the construction of shaft 12 is done using conventional techniques, including the placement of suitable reinforcing steel therein as would be apparent to those skilled in the art.

Figure 12:
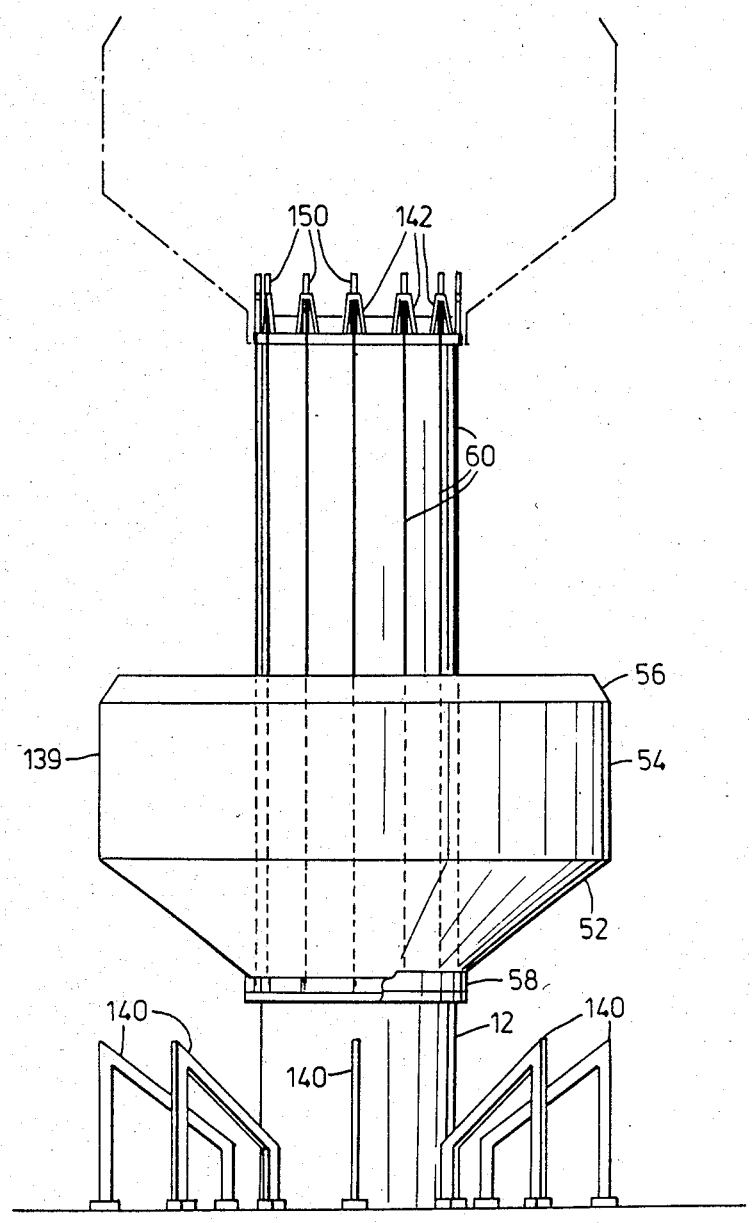
FIG. 12 is a diagramatic, elevational view of the storage tank showing the partial tank that was fabricated at the base of the tower being raised into position at the top of the tower.

Once shaft 12 has been substantially completed, the wall portions and lower ring beam of tank 14 are fabricated concentrically about the base of shaft 12 to form a partial tank 139. This may be done using suitable jig structures 140 as shown in FIG. 12. Jack stands 142 (see FIG. 13) are then temporarily mounted on outer ledge 30 in the spaces between concrete gussets 40. Each jack stand 142 is in the nature of an A-frame with upper and lower tie back plates 144, 146. Removeable braces (not shown) are connected to the back plates 144, 146 to anchor or retain the jack stands in position. The legs of the jack stands are located on resilient pads 148 typically formed of 1 inch thick neoprene rubber. There are typically 12 to 36 jack stands 142, and the resilient pads 148 balance or equalize the load carried by each jack stand as the partial tank 139 is hoisted into position. Hydraulic jacks 150 are mounted on top of jack stands 142, and these jacks act on lifting cables 60 which are connected to knife plates 68 as mentioned above. Spring loaded jaw-type anchors 152 are mounted in jack stands 142 to grip and retain the lifting cables 60 when jacks 150 reach the limit of their extension and must be returned for a fresh grip on the lifting cable.

Jacks 150 are hydraulically connected to a common source of hydraulic pressure so that they can be operated in unison for lifting the tank. The jacks can also be operated separately for lifting and alignment of the tank as well. The jacks are operated until the partial tank 139 is lifted into the position shown in chain dotted lines in FIG. 12. It will be appreciated from FIGS. 5 and 6, that as the partial tank is hoisted to the top of shaft 12, lifting cables 60 and knife plates 68 pass upwardly through recesses 32. The partial tank is hoisted until knife plates 68 are slightly above outer ledge 30. At this point, closure plates 154 are inserted to span the gap between ring beam 58 and outer ledge 30. Shims 156 are then placed under knife plates 68 to bridge recesses 32. The tank is then lowered slightly until knife plates 68 rest on and are supported by shims 156. Lifting cables 60 are then detached from knife plates 68 and jack stands 142 are removed. At this point, it will be appreciated that ring beam 58, closure plates 154 and the upper end portion of shaft wall 18 form an annular recess. Suitable reinforcing steel is then placed in this recess and it is filled with concrete 158 to form a complete tank support floor, to connect the steel partial tank 139 to the upper end portion of the concrete shaft, to form a water-tight tank, and to transmit the forces generated in the conical tank floor and ring beam to the concrete thrust ring 26 when the tank is filled with liquid.

Although tank 14 is watertight at this point, it is desirable to instal a steel floor liner 160 to cover the tank support floor. The peripheral edge of floor liner 160 is welded to angle 74 and also to the central access tube 84 and the drain and fill pipes, so that tank 14 has a continuous steel floor to make it absolutely watertight. In order to ensure that floor liner 160 does not itself support any structural loads, holes are drilled in the floor liner and grout 162 is forced beneath floor liner 160 to fill any voids located beneath the liner. The holes are then capped or plugged in a suitable manner.

Access tube assembly 82 is then installed as mentioned above and roof plates 130 are installed to complete the tank roof. Finally, the remaining elements such as the covers for access and vent openings 106, 108, the remainder of the piping, additional ladders, cat walks, etc., and the pumps and valves are installed to complete the construction.

Figure 14:
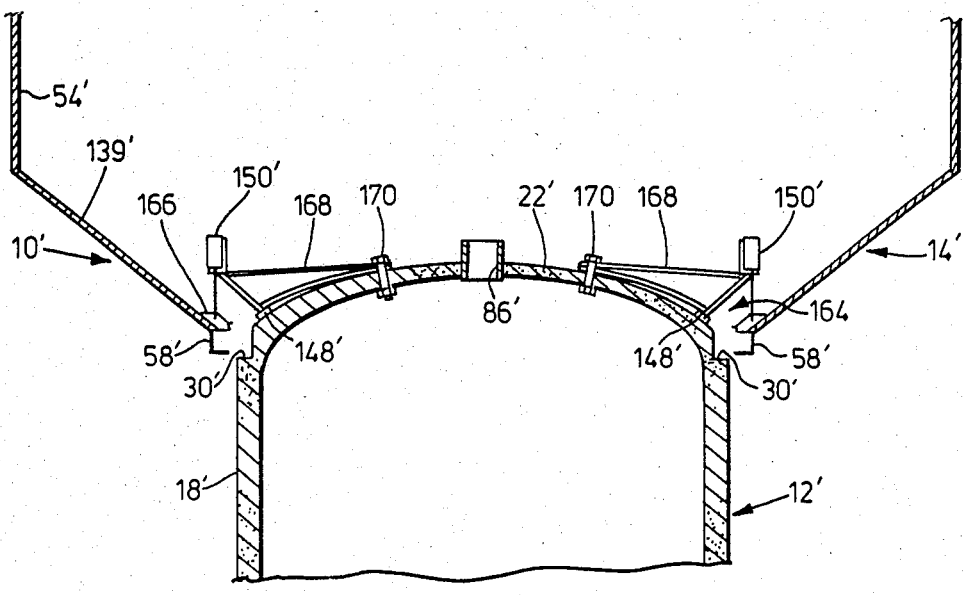
FIG. 14 is a vertical sectional view illustrating another embodiment and method of connecting the shaft to the partial tank.
Figure 15:
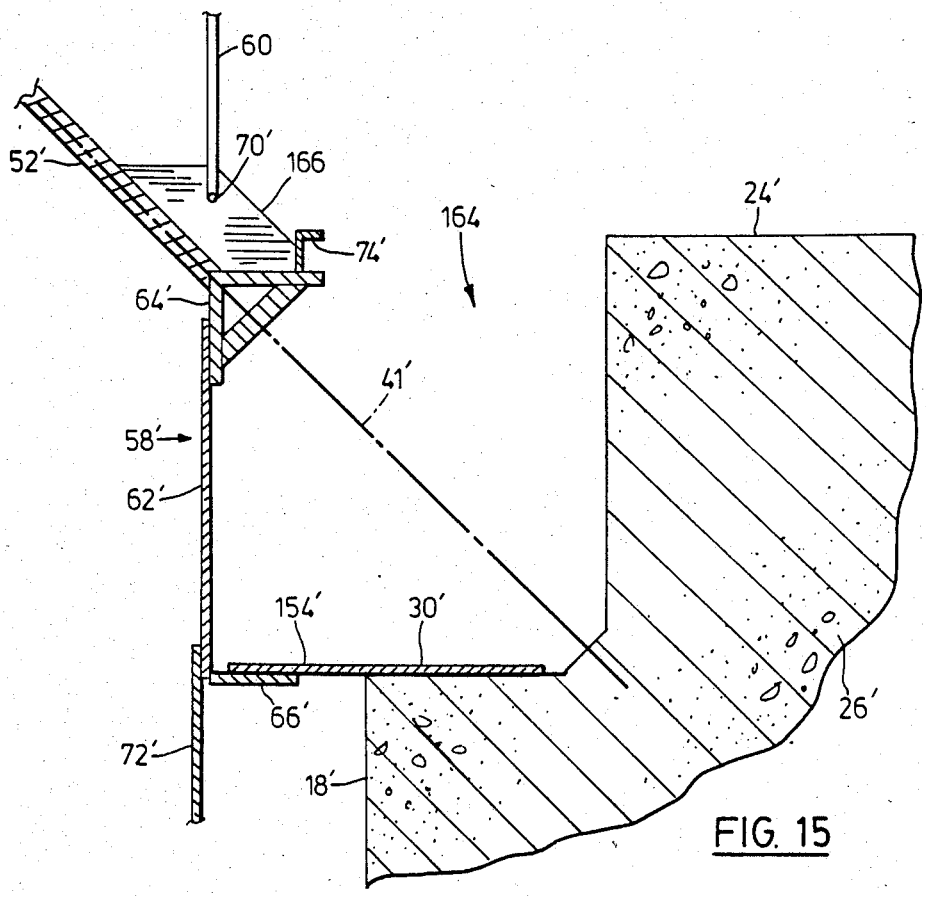
FIG. 15 is a vertical sectional view similar to FIG. 5 but showing the embodiment illustrated in FIG. 14 on an enlarged scale.

Referring next to FIGS. 14 and 15, another embodiment of an elevated liquid storage tank and method of constructing same according to the present invention will now be described. In FIGS. 14 and 15, primed reference numerals are used to illustrate components which are similar to the embodiments shown in FIGS. 1 to 13. The main difference between storage tank 10' and the previously described storage tank lies in the manner in which the steel tank 14' is connected to the concrete shaft 12'.

Rather than providing a corbel adjacent to the shaft upper end portion, shaft 12' has an upper, peripheral, annular recess 164 forming the upper, outwardly disposed outer ledge 30'. Ring beam 58' is formed without knife plates and partial steel tank 139' is lifted into position by attaching lifting cables 60 to circumferentially spaced apart gusset plates 166 connected between floor portion 52' and top angle 64'. Annular recess 164, ring beam 58' and closure plates 154' then form a U-shaped annular recess which is filled with reinforced concrete (not shown) in a manner similar to the previous embodiments to connect the partial tank to the upper end portion of the concrete shaft. In this embodiment, top angles 64' form radially inwardly projecting support means for tank 14'. As in the case of the previous embodiments, the annular connection or seal between tank 14' and shaft 12' makes the tank water-tight and transmits the forces generated in the conical tank floor and ring beam to the concrete trust ring 26' when the tank is filled with liquid. A steel floor liner (not shown) can also be installed as in the previous embodiments.

In order to ensure that lifting cables 60 remain generally vertical while partial tank 139' is being lifted, it is necessary to provide a cantilever structure 168 to hold each of the jacks 150' out over the point of attachment of the lifting cables. Cantilever structures 168 are anchored to the tank partial support floor 22' by suitable temporary anchors 170 and resilient pads 148' are provided under the outer ends of cantilever structures 168 to balance or equalize the load carried by each jack as in the previous embodiments. Jacks 150' must remain in place until the concrete joint or seal is made between partial tank 139' and shaft 12', and thereafter the jacks and cantilever structures are removed and the remainder of the tank is completed in a manner similar to that for the previously described embodiments.

Having described preferred embodiments of this invention, it will be appreciated that various modifications may be made to the structures and methods described. For example, where knife plates 68 are used, they do not have to pass through recesses 32 in corbel 28. The knife plates, or or supporting members, could be made so that they do not project inwardly as far as the outer ledge 30, and some other type of shim member could be used for supporting the knife plates on the outer ledge. After the reinforced concrete 58 has been poured to connect the ring beam to the upper end portion of the shaft, it is this reinforced concrete filler that transmits the load of the tank wall to the shaft. Knife plates 68 could be installed after the tank has been hoisted into position at the top of the shaft, and in this case, the recesses in the corbel could be also be eliminated. In fact, the corbel itself could be eliminated by forming outer ledge 30 in the top of wall 18 as in the embodiment shown in FIGS. 14 and 15. It may be necessary to attach the lifting cables at a different location on the ring beam or move the jacks further outwardly to keep the lifting cables generally vertical. It will also be apparent to those skilled in the art that the tank support floor 22 could be other configurations than convex, such as flat or conical. In fact, tank support floor 22 could be formed of steel rather than reinforced concrete. Also, the access tube assembly could be mounted in the tank support floor in another manner, with or without an access opening through the floor. The access opening could be provided in another location in the floor, or access to the interior of the tank could be through the roof only. Various other modifications or alternatives will be apparent to persons skilled in the art, and all of these variations or modifications are considered to be within the scope of the present invention.

What I claim as my invention is:

1. A method of constructing an elevated liquid storage tank comprising:

erecting an upright, hollow cylindrical shaft including a closed upper end portion forming a partial tank support floor having a top surface, the shaft also including an upright wall having an upper, outer ledge formed around the periphery of the shaft and spaced below said top surface;

fabricating a partial annular steel tank concentrically about the base of the shaft, said partial tank including a wall having a lower annular ring beam with inwardly projecting support members;

hoisting the partial tank to the top of the shaft so that said ring beam is opposite to the ledge forming a continuous annular recess around the periphery of the shaft; and filling the annular recess with reinforced concrete to connect the partial tank to the shaft.

2. A method as claimed in claim 1 and further comprising the step of inserting shim members between the ledge and the support members to support the partial tank on the ledge before filling the annular recess with concrete.

3. A method as claimed in claim 2 wherein the erection of the shaft includes the step of forming in the outer ledge a plurality of radially disposed, outwardly opening recesses for passing said projecting support members therethrough as the partial tank is hoisted to the top of the shaft.

4. A method as claimed in claim 3 wherein said shim members are inserted to span said vertical recesses after the partial tank is hoisted into position, and further comprising the step of lowering the partial tank so that said support members rest on the shims.

5. A method as claimed in claim 1 wherein the partial tank is hoisted to the top of the shaft by providing a plurality of jacks mounted circumferentially around the shaft upper end portion and connecting cables between the jacks and the ring beam, the jacks pulling the cables upwardly to lift the partial tank.

6. A method as claimed in claim 5 and further comprising the step of mounting the jacks on the outer ledge, the jacks being mounted on jack stands supported on resilient pads to equalize the lifting loads of the jacks.

7. A method as claimed in claim 3 and further comprising the step of erecting a roof on the partial tank after the partial tank has been hoisted to the top of the shaft.

8. A method as claimed in claim 1 and further comprising the step of inserting a floor liner into the partial tank overlying the tank support floor, and sealingly connecting the periphery of the floor liner to the partial tank wall.

9. A method as claimed in claim 7 and further comprising the step of inserting a floor liner into the partial tank overlying the tank support floor, and sealingly connecting the periphery of the floor liner to the partial tank wall.

10. A method as claimed in claim 8 and further comprising the step of forcing grout beneath the floor liner to fill any voids located below the floor liner.

11. A method as claimed in claim 9 and further comprising the step of forcing grout beneath the floor liner to fill any voids located below the floor liner.

* * * * *